United States Patent [19]

Folsom

[11] Patent Number: 5,010,822

[45] Date of Patent: Apr. 30, 1991

[54] EXPLOSIVE INITIATOR WITH ANGLED FIBER OPTIC INPUT

[75] Inventor: Mark Folsom, Hollister, Calif.

[73] Assignee: Whittaker Ordnance, Inc., Hollister, Calif.

[21] Appl. No.: 473,785

[22] Filed: Feb. 2, 1990

[51] Int. Cl.[5] ..... F42C 13/02

[52] U.S. Cl. ..... 102/201; 60/39.821

[58] Field of Search ..... 102/201, 202, 200; 60/39.821; 372/77

[56] References Cited

U.S. PATENT DOCUMENTS

| | | | |
|---|---|---|---|
| 3,296,795 | 1/1967 | Nielsen | 102/201 |
| 3,408,937 | 11/1968 | Lewis et al. | 60/39.821 |
| 3,618,526 | 11/1971 | Baker | 372/77 |
| 4,870,903 | 10/1989 | Carel et al. | 102/201 |
| 4,917,014 | 4/1990 | Loughry et al. | 102/201 |

FOREIGN PATENT DOCUMENTS

| | | | |
|---|---|---|---|
| 1031215 | 5/1978 | Canada | 102/201 |

OTHER PUBLICATIONS

Crosby et al.; Nondestructive Laser Pumping by High Explosives; pp. 1339–1340, Applied Optics, 12/63.

*Primary Examiner*—Deborah L. Kyle
*Assistant Examiner*—Stephen Johnson
*Attorney, Agent, or Firm*—Donald E. Nist

[57] ABSTRACT

The explosive initiator features an angled fiber optic adapter connected thereto. The initiator includes an elongated tubular cartridge with a longitudinal passageway having input and output ends and an explosive disposed therein downstream of a transparent sealing window and upstream of an output closure. The adapter has an elongated passageway therethrough with input and output ends and divided into a first portion at an angle of preferably 90 degrees from the longitudinal axis of the cartridge and a second portion in line with the cartridge. A mirror lens is positioned in the adapter passageway at the intersection of the two portions for reflecting a light beam from an optical fiber in the inlet end of the adapter to the cartridge passageway and focusing the light beam on the window. Preferably the second portion of the adapter is rotatably mounted to the cartridge. In one embodiment, the first portion is rotatably mounted to the second portion and includes two sub-portions at an angle to each other and bearing a mirror at the intersection thereof. With this arrangement, the initiator can receive an optical fiber from various locations without strain on the fiber.

6 Claims, 1 Drawing Sheet

EXPLOSIVE INITIATOR WITH ANGLED FIBER OPTIC INPUT

BACKGROUND OF THE INVENTION

1. Field of the Invention

The present invention generally relates to explosive initiators and more particularly to a new type of initiator which is activated through the use of a focused beam of light.

2. Prior Art

Most explosive initiators are in the form of a cartridge having a generally cylindrical shape, and having threads on the explosive output end, a flange near the middle of the initiator with some type of wrenching configuration and some means for introducing initiation energy into the input end of the initiator opposite from the output end. In the case of an optical initiator, light energy is typically supplied through an optical fiber that is terminated with a standard type of fiber-optic connector that mates with the input end of the initiator cartridge.

A sealed optical initiator cartridge must have a transparent window that allows light energy to pass through it while still providing the necessary sealing function to protect the cartridge contents, including the explosive therein, against environmental degradation and in some cases contain the products of reaction in the cartridge following the initiation. The window of a typical initiator is merely a flat piece of glass and has no focusing effect on the light passing through it. Thus, light continues to spread out in a cone configuration from the moment it leaves the output end of the optical fiber, as it passes through the window and until it impinges on the explosive behind the window. This requires a higher light energy output than with a focused beam of light because the unfocused beam spreads the light out over a greater area and is absorbed by a greater quantity of material to be initiated.

Standard fiber-optic connectors are typically 1.2 inches long and are usually used with a strain relief boot attached thereto which adds another 1 inch in length. Moreover, most optical fiber cannot be bent to a smaller radius than about 1 inch. As a result, a typical optical explosive initiator with a typical connector and optical fiber attached require about 3 inches of clearance above the surface on which the initiator cartridge is typically mounted. In addition, even if such clearance is available, the resulting rigid mounting of the fiber end can cause excessive bending stress in the fiber, when the fiber is subjected to forces perpendicular or in other directions from the main axis of the cartridge.

Accordingly, there remains a need for an improved explosive initiator which permits light emitted from an optical fiber end to turn through an angle, preferably a right angle so as to permit the clearance required above the mounting surface for the initiator cartridge to be reduced from about 3 inches to as little as about 0.5 inch, while still using standard fiber optic connector components. It would also be desireable if the initiator permitted the connector and fiber end to rotate freely around the cartridge axis so as to increase mounting flexibility and reduce bending stress on the optical fiber. Further, it would be desireable if the light from the fiber could be focused in the initiator so as reduce the light energy required to initiate the explosive reaction.

SUMMARY OF THE INVENTION

The improved explosive initiator of the present invention satisfies all the foregoing needs. Thus, the initiator is substantially as set forth in the Abstract of the Disclosure.

The initiator comprises the usual generally cylindrical cartridge case with internal explosives sealed off by an upstream transparent window and downstream exit closure. In addition, an adapter of a special configuration is connected, preferably rotatably connected, to the cartridge inlet and extends upstream at an angle thereto, preferably at about 90 degrees to the main axis thereof. The adapter includes a first upstream portion extending at an angle to the cartridge main axis and having an inlet which releasably holds the outlet end of an optical fiber therein in a fixed position, and a second portion in line with the inlet end of the cartridge.

Both the adapter and cartridge have longitudinally extending communicating passageways. A hemispherical mirror lens is fixed within the adapter passageway at the intersection of the first and second portions, so as to direct an incoming beam of light into the second portion and then into the cartridge passageway and focus it on the cartridge window.

In one embodiment, the first portion is divided into first and second sub-portions contiguous with each other and at an angle to each other, a mirror being positioned in the passageway at the point of intersection therebetween. Moreover, the first portion may be rotatably connected to the second portion so as to provide additional pivoting ability for the upstream fiberholding end of the adapter.

Thus, the required clearance for the device above the cartridge mounting surface is reduced to about 0.5 inch, stressing of the optic fiber is substantially eliminated and the light energy needed to initiate an explosive reaction is reduced, all due to the improved initiator.

Further features of the improved initiator of the present invention are set forth in the following detailed description and accompanying drawings.

DRAWINGS

DETAILED DESCRIPTION

Figure 1:
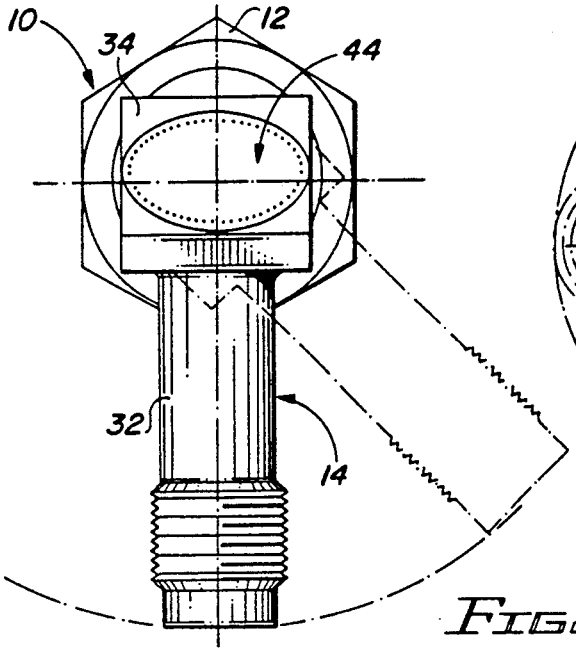
FIG. 1 is a schematic front elevation of a first preferred embodiment of the improved explosive initiator of the present invention.
Figure 2:
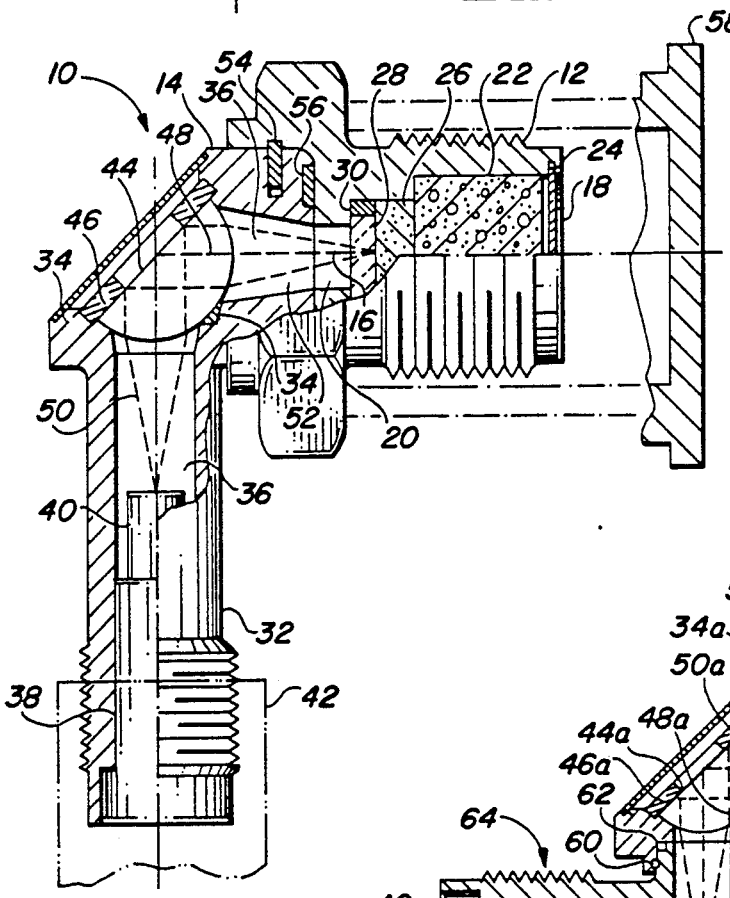
FIG. 2 is a schematic side elevation, partly broken away and partly in section, of the initiator of FIG. 1.

FIGS. 1 and 2.

Now referring more particularly to FIGS. 1 and 2 of the accompanying drawings, a first preferred embodiment of the improved explosive initiator of the present invention is schematically depicted therein. Thus, initiator 10 is shown, which comprises a generally cylindrical cartridge 12 of metal or the like to which is rotatably connected an adapter 14 of novel configuration. Cartridge 12 has a central passageway 16 extending the length thereof, with an output end 18 and an opposite input end 20. A load 22 of explosive is disposed in the downstream portion of cartridge passageway 16 and is protected by an output closure 24 of metal or the like sealing off output end 18. Prime explosive 26 is disposed in passageway 16 just upstream of load 22 and just downstream of a transparent sealing window 28 of flat glass or the like in passageway 16. Window 28 may abut a peripheral hermetic seal 30 of solder glass or the like.

Adapter 14 includes a first portion 32 at an angle, preferably a 90 degree angle, from the main axis of cartridge 12, as shown in FIG. 2, integrally connected to second portion 34 which is in line with the main axis of cartridge 12. A central passageway 36 runs the length of adapter 14, which adapter may be of metal or the like Input end 38 of passageway 36 is at the upstream end of adapter 14 and releasably holds the output end of an optical fiber 40, which fiber is disposed in a fiber optic connector 42

A unitary hemispherical mirror lens 44 is held in a fixed position at the intersection of portions 32 and 34 in passageway 36, so that the flat rear mirror portion 46 thereof is at a 45 degree angle to the main axis of portion 32 and also that of portion 34, and so that the hemispherical lens portion 48 faces both portions 32 and 34. In this way, a light beam 50 diverging from fiber 40 passes downstream through portion 32, is reflected off of mirror 46, which may be plated on the rear end of lens 48, and is focused by lens 48, which may be of glass, plastic or the like, so as to exit the output end 52 of passageway 36 and focus on window 28 for optimal explosive initiation of the prime explosive 26 and then load 22.

An important feature of initiator 10 is that the downstream end of portion 34 is rotatably sealingly engaged to the upstream end of cartridge 12, as by a peripheral snap retaining ring 54 and a peripheral seal ring 56, as shown in FIG. 2. This enables adapter 14 to rotate around the longitudinal axis of cartridge 12, as shown in FIG. 1, so as minimize the clearance required between fiber 40 and the point of connection of cartridge 12 to a support body( not shown). The output end of cartridge 12 may also be protected with a removeable cap 58 of metal, rubber or the like until it is ready for use.

Initiator 10 is simple, compact, inexpensive and versatile. It provides the described minimum clearance without placing any stress on fiber 40 and although its rotatable adapter 14 is permanently sealed to cartridge 12 for maximum protection of lens 48 and window 28. Moreover, mirror lens 48 provides the desired reflection and focusing action to enhance the capability of initiator 10.

Figure 4:
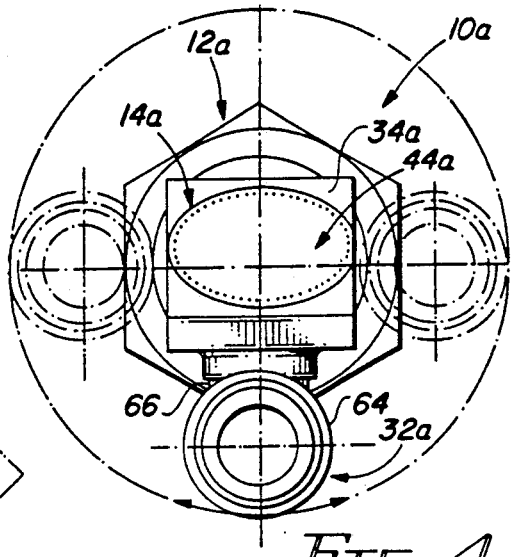
Figure 3:
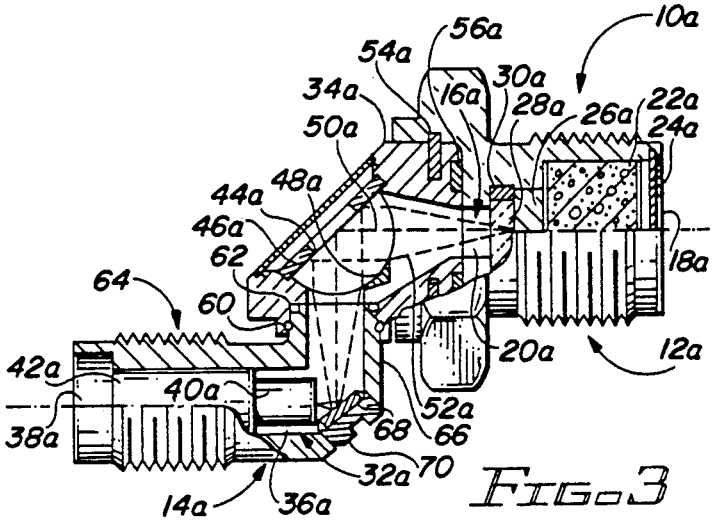
FIG. 3 is a schematic side elevation, partly broken away and partly in section, of a second preferred embodiment of the improved explosive initiator of the present invention; and, FIG. 4 is a schematic front elevation of the initiator of FIG. 3.

FIGS. 3 and 4.

A second preferred embodiment of the improved explosive initiator of the present invention is schematically depicted in FIGS. 3 and 4. Thus, initiator **10*a* is shown. Components thereof which are similar to those of initiator 10** bear the same numerals but are succeeded by the letter "a".

Initiator **10*a* is substantially identical to initiator 10**, except as follows:

(a) portion **32*a* is rotatably and sealingly connected to portion 34*a*, as by a retaining ring 60 and an o-ring seal 62, so that portion 32*a* rotates around an axis perpendicular to the longitudinal axis of cartridge 12*a* for additional utility of initiator 10*a*, as contrasted with initiator 10; and, (b) portion 32*a* is divided into two contiguous subportions 64 and 66 disposed at an angle of about 90 degrees from each other and provided in passageway 36*a* with a flat reflecting mirror 68 at the intersection thereof, mirror 68 being at an angle of 45 degrees to the longitudinal axes of both sub-portions 64 and 66 so as to direct a light beam passing through sub-portion 64 into sub-portion 66. Mirror 68 may be held in place by a retainer 70**.

Initiator **10*a* can angle an optical fiber held in subportion 64 in any one of a number of directions and still have a beam of light therefrom strike window 28*a* in a focused manner. Accordingly, the versatility of initiator 10*a*** is improved.

Various other features of the initiator of the present invention are as set forth in the foregoing It will be understood that adapters 14 and **14*a* could be connected to cartridges 12 and 12*a***, respectively, in a non-rotatable manner, if desired, while still retaining the other features of the present invention.

Other modifications, changes, alterations and additions can be made in the improved initiator of the present invention, its components and their parameters. All such modifications, changes, alterations and additions as are within the scope of the appended claims form part of the present invention.

What is claimed is:

1. An improved explosve initiator with an angled fiber optic input, said initiator comprising, in combination:

(a) a hollow elongated initiator cartridge having a longitudinal axis and a longitudinal passageway extending therethrough with an input end and an output end, an explosve positioned in said passageway, said explosive being explosively responsive to light of sufficient intensity and appropriate wavelength, a transparent window in said passageway sealing said explosive from said input end, and an output closure in said passageway downstream of said explosive; and, (b) a hollow adapter connected to said cartridge input end, a part of said adapter extending at an angle from said longitudinal axis of said cartridge, said adapter having a longitudinal passageway extending therethrough with an output end adjacent to said cartridge input end and with an input end for holding the output end of an optical fiber having an output end and an input end, said adapter having a first portion containing said adapter input end and being at an angle to said cartridge longitudinal axis, and having a second portion containing said adapter output end and being in line with said cartridge longitudinal axis, said first and second adapter portions intersecting, and a mirror lens disposed in said adapter passageway at the intersection of said first and second adapter portions for reflection of a light beam from said optical fiber into said cartridge passageway and for focusing said beam on said window to initiate said explosion.

2. The improved initiator of claim 1 wherein said adapter is rotatably connected to said cartridge and is in sealing engagement therewith.

3. The improved initiator of claim 1 wherein said mirror lens is hemispherical and wherein said first portion is at a 90 degree angle to said second portion and said cartridge.

4. The improved initiator of claim 1 wherein said adapter input end has a holding position for said optical fiber and that position in said adapter input end is the same distance from said mirror lens as is said window from said mirror lens.

5. The improved initiator of claim 1 wherein said first portion is rotatably secured to said second portion and said first portion includes first and second sub-portions disposed at an angle to each other so as to intersect, with a mirror at the intersection of said sub-portions.

6. The improved initiator of claim 5 wherein said angle between said two sub-portions is 90 degrees and wherein said angle between said cartridge and first portion is also 90 degrees.

* * * * *